US007584801B2

(12) United States Patent
deBoer

(10) Patent No.: US 7,584,801 B2
(45) Date of Patent: Sep. 8, 2009

(54) DRILL STRING FLOW CONTROL VALVES AND METHODS

(75) Inventor: Luc deBoer, Houston, TX (US)

(73) Assignee: Dual Gradient Systems, LLC, Richmond, TX (US)

( * ) Notice: Subject to any disclaimer, the term of this patent is extended or adjusted under 35 U.S.C. 154(b) by 0 days.

(21) Appl. No.: 11/788,660

(22) Filed: Apr. 20, 2007

(65) Prior Publication Data

US 2007/0246265 A1 Oct. 25, 2007

Related U.S. Application Data

(60) Provisional application No. 60/793,883, filed on Apr. 21, 2006.

(51) Int. Cl.
*E21B 21/10* (2006.01)

(52) U.S. Cl. ..... 166/386; 166/321; 175/243; 175/318

(58) Field of Classification Search ..... 175/232, 175/243, 317, 318, 218, 234, 235; 166/386, 166/334.4, 320, 321; 137/87.06
See application file for complete search history.

(56) References Cited

U.S. PATENT DOCUMENTS 5,174,392 A * 12/1992 Reinhardt ..... 175/107
5,924,490 A * 7/1999 Stone ..... 166/312
2002/0020558 A1* 2/2002 Gonzalez et al. ..... 175/5
2007/0084607 A1* 4/2007 Wright et al. ..... 166/373

OTHER PUBLICATIONS

Gay, Jennifer H. (authorized officer), International Search Authority/US, International Search Report, Dec. 26, 2007, 4 pages, United States Patent Office Patent Cooperation Treaty, Alexandria, Virginia.
Gay, Jennifer H. (authorized officer), International Search Authority/US, Written Opinion of the International Searching Authority, Dec. 26, 2007, 4 pages, United States Patent Office Patent Cooperation Treaty, Alexandria, Virginia.

* cited by examiner

*Primary Examiner*—Jennifer H Gay
*Assistant Examiner*—Robert E Fuller
(74) *Attorney, Agent, or Firm*—Mark A. Tidwell; Jackson Walker L.L.P.

(57) ABSTRACT

Drill string flow control valves and more particularly, drill string flow control valves for prevention of u-tubing of fluid flow in drill strings are provided. Drill string flow control valves may comprise a valve housing, a valve sleeve axially movable within a valve housing from a closed position to an open position, a biasing mechanism for biasing the valve sleeve into the closed position, and a plurality of pressure ports for allowing a differential pressure to be exerted on the valve sleeve. The differential pressure exerted on the valve sleeve may be the result of an upstream pressure and a downstream pressure. By allowing a differential pressure resulting from a fluid flow to act on the valve sleeve, u-tubing in a drill string can be prevented or substantially reduced. Methods of use are also provided.

21 Claims, 5 Drawing Sheets

DRILL STRING FLOW CONTROL VALVES AND METHODS

RELATED APPLICATION

This application claims priority to provisional application Ser. No. 60/793,883, entitled "Drill String Flow Control Valve" filed on Apr. 21, 2006, the full disclosure of which is hereby incorporated by reference in full.

BACKGROUND

The present invention generally relates to drill string flow control valves and more particularly, drill string flow control valves for prevention of u-tubing of fluid flow in drill strings and well drilling systems.

Managed Pressure Drilling (MPD) and Dual Gradient Drilling are oilfield drilling techniques which are becoming more common and creating a need for equipment and technology to make them practical. These drilling techniques often utilize a higher density of drilling mud inside the drill string and a lower density return mud path on the outside of the drill string. Examples of such dual gradient drilling techniques are disclosed in U.S. Pat. No. 7,093,662.

In dual gradient drilling, an undesirable condition called "u-tubing" can result when the mud pumps for a drilling system are stopped. Mud pumps are commonly used to deliver drilling mud into the drill string and to extract return mud from the well bore and a return riser (or risers). In a typical u-tubing scenario, fluid flow inside a drill string may continue to flow, even after the mud pumps have been powered down, until the pressure inside the drill string is balanced with the pressure outside the drill string, e.g. in the well bore and/or a return riser (or risers). This problem is exacerbated in those situations where a heavier density fluid precedes a lighter density fluid in a drill string. In such a scenario, the heavier density fluid, by its own weight, can cause continued flow in the drill string even after the mud pumps have shut off. This u-tubing phenomenon, can result in undesirable well kicks, which can cause damage to a drilling system. For this reason, it is desirable that when mud pumps in a drilling system are turned off, the forward fluid flow be discontinued quickly.

SUMMARY

The present invention generally relates to drill string flow control valves and more particularly, drill string flow control valves for prevention of u-tubing of fluid flow in drill strings and well drilling systems.

Drill string flow control valves of the present invention utilizes the pressure differential between certain pressure ports positioned to apply pressure to a valve sleeve within a valve housing to cause actuation of the valve sleeve, so as to control the operation of the drill string flow control valve. More specifically, drill string flow control valves may comprise a valve housing, a valve sleeve axially movable within a valve housing from a closed position to an open position, a biasing mechanism for biasing the valve sleeve into the closed position, and a plurality of pressure ports for allowing a differential pressure to be exerted on the valve sleeve. A differential pressure exerted on the valve sleeve may be the result of an upstream pressure and a downstream pressure. By allowing a differential pressure resulting from a fluid flow to act on the valve sleeve, u-tubing in a drill string can be prevented or substantially reduced.

One example of a drill string flow control valve comprises a valve housing wherein the valve housing has a housing flow path from a housing flow inlet to a housing outlet flow port; a valve sleeve disposed at least partially in the valve housing, the valve sleeve having a sleeve flow port wherein the valve sleeve is axially movable within the valve housing from a closed position to an open position, such that the sleeve flow port substantially impedes fluid flow from the housing outlet flow port to the sleeve flow port when the valve sleeve is in the closed position and wherein the sleeve flow port allows fluid flow from the housing outlet flow port to the sleeve flow port when in the open position; wherein the valve sleeve has an upper pressure surface defined thereon so as to provide a partial cross-sectional surface area upon which a first fluid pressure may act to provide a downward force on the valve sleeve and wherein the valve sleeve has a lower pressure surface defined thereon so as to provide a partial cross-sectional surface area upon which a second fluid pressure may act to provide an upward force on the valve sleeve; a spring wherein the spring biases the valve sleeve to the closed position by exertion of a biasing force on the valve sleeve; an upper pressure port that allows the first fluid pressure to act upon the upper pressure surface from the housing flow path; and a lower pressure port that allows the second fluid pressure to act upon the lower pressure surface from external the valve housing.

Another example of a drill string flow control valve comprises a valve housing wherein the valve housing has a housing flow path from a housing flow inlet to a housing outlet flow port; a valve sleeve disposed at least partially in the valve housing, the valve sleeve having a sleeve flow port wherein the valve sleeve is axially movable within the valve housing from a closed position to an open position, such that the sleeve flow port substantially impedes fluid flow from the housing outlet flow port to the sleeve flow port when the valve sleeve is in the closed position and wherein the sleeve flow port allows fluid flow from the housing outlet flow port to the sleeve flow port when in the open position; wherein the valve sleeve has an upper pressure surface defined thereon so as to provide a partial cross-sectional surface area upon which a first fluid pressure may act to provide a downward force on the valve sleeve and wherein the valve sleeve has a lower pressure surface defined thereon so as to provide a partial cross-sectional surface area upon which a second fluid pressure may act to provide an upward force on the valve sleeve; a biasing mechanism wherein the biasing mechanism biases the valve sleeve to the closed position; an upper pressure port that allows the first fluid pressure to act upon the upper pressure surface from the housing flow path; and a lower pressure port that allows the second fluid pressure to act upon the lower pressure surface from external the valve housing.

An example of a method for preventing u-tubing in a drill string comprises providing a valve housing wherein the valve housing has a housing flow path from a housing flow inlet to a housing outlet flow port; providing a valve sleeve disposed at least partially in the valve housing, the valve sleeve having a sleeve flow port wherein the valve sleeve is axially movable within the valve housing from a closed position to an open position, such that the sleeve flow port substantially impedes fluid flow from the housing outlet flow port to the sleeve flow port when the valve sleeve is in the closed position and wherein the sleeve flow port allows fluid flow from the housing outlet flow port to the sleeve flow port when in the open position wherein the valve sleeve has an upper pressure surface defined thereon so as to provide a partial cross-sectional surface area upon which a first fluid pressure may act to provide a downward force on the valve sleeve and wherein the valve sleeve has a lower pressure surface defined thereon so as to provide a partial cross-sectional surface area upon which a second fluid pressure may act to provide an upward force on the valve sleeve; providing a biasing mechanism wherein the biasing mechanism biases the valve sleeve to the closed position by exerting a biasing spring force on the valve sleeve; providing an upper pressure port that allows the first fluid pressure to act upon the upper pressure surface from the housing flow path with an upper force; providing a lower pressure port that allows the second fluid pressure to act upon the lower pressure surface from external the valve housing with a lower force; increasing a fluid pressure upon the valve sleeve so as to cause the valve sleeve to shift from the closed position to the open position; maintaining a fluid flow through the valve sleeve so that the upper force is greater than the biasing spring force plus the lower force; and decreasing the fluid flow through the valve sleeve so as to allow the biasing mechanism to shift the valve sleeve from the open position to the closed position.

An example of a drill string flow control valve system comprises a valve housing wherein the valve housing has a housing flow path from a housing flow inlet to a housing outlet flow port; a valve sleeve disposed at least partially in the valve housing, the valve sleeve having a sleeve flow port wherein the valve sleeve is axially movable within the valve housing from a closed position to an open position, such that the sleeve flow port substantially impedes fluid flow from the housing outlet flow port to the sleeve flow port when the valve sleeve is in the closed position and wherein the sleeve flow port allows fluid flow from the housing outlet flow port to the sleeve flow port when in the open position; wherein the valve sleeve has an upper pressure surface defined thereon so as to provide a partial cross-sectional surface area upon which a first fluid pressure may act to provide a downward force on the valve sleeve and wherein the valve sleeve has a lower pressure surface defined thereon so as to provide a partial cross-sectional surface area upon which a second fluid pressure may act to provide an upward force on the valve sleeve; a biasing mechanism wherein the spring biases the valve sleeve to the closed position by exertion of a biasing force on the valve sleeve; a flow restriction in fluid communication with the valve sleeve; an upper pressure port that allows the first fluid pressure to act upon the upper pressure surface from the housing flow path wherein the first fluid pressure is measured upstream of the flow restriction; and a lower pressure port that allows the second fluid pressure to act upon the lower pressure surface from external the valve housing wherein the second fluid pressure is measured downstream of the flow restriction.

Yet another example of a drill string flow control valve system comprises a valve housing having an external surface and a first flow path therein; a valve sleeve slidingly mounted in the valve housing; a biasing mechanism for biasing the valve sleeve in a closed position; a first pressure port acting on a first portion of the sleeve and in fluid communication with the first flow path; and a second pressure port acting on a second portion of the sleeve and in fluid communication with a second flow path.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein.

Figure 1:
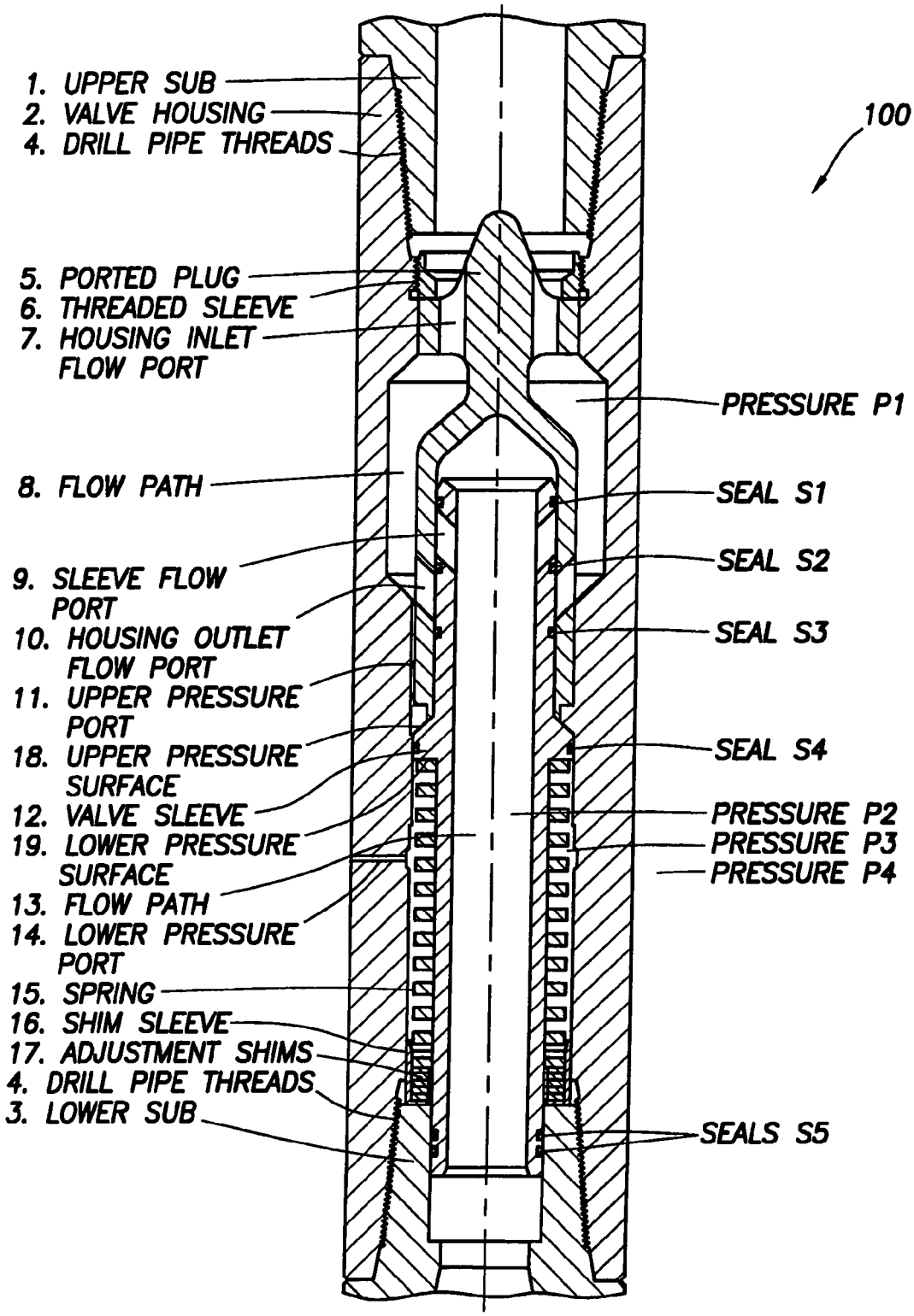
FIG. 1 illustrates a cross-sectional view of a drill string flow control valve.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF PREFERRED EMBODIMENTS

The present invention generally relates to drill string flow control valves and more particularly, drill string flow control valves for prevention of u-tubing of fluid flow in drill strings and well drilling systems.

Drill string flow control valves are provided herein that, among other functions, can be used to reduce and/or prevent u-tubing effects in drill strings.

To facilitate a better understanding of the present invention, the following examples of certain embodiments are given. In no way should the following examples be read to limit, or define, the scope of the invention.

For ease of reference, the terms "upper," "lower," "upward," and "downward" are used herein to refer to the spatial relationship of certain components. The terms "upper" and "upward" refer to components towards the surface (distal to the drill bit), whereas the terms "lower" and "downward" refer to components towards the drill bit (or proximal to the drill bit), regardless of the actual orientation or deviation of the wellbore or wellbores being drilled. The term "axial" refers to a direction substantially parallel to the drill string in proximity to a drill string flow control valve.

FIG. 1 illustrates a cross-sectional view of a drill string flow control valve in accordance with one embodiment of the present invention. Drill string flow control valve 100 is shown inline in a drill string, connected at drill pipe threads 4 to upper sub 1 and lower sub 3. Drill string flow control valve 100 may be installed in the drill string at any point in the drill string above the drill bit. One or more components such as drill pipe joints/sections, MWD components, heavy-walled drill pipe, or any number BHA components may be installed between drill string flow control valve 100 and the drill bit.

Drill string flow control valve 100 is generally comprised of a valve housing 2 and a valve sleeve 2 slidingly mounted therein. Drill string control 100 may also include ported plug 5 to direct fluid flow within valve housing 2. Although valve housing 2 and ported plug 5 are shown here as two or more components, in certain embodiments, these two components may be formed as one integral piece. Valve sleeve 12 is disposed in valve housing 2 and is axially slidable or movable within valve housing 2, and more particularly, in this embodiment, partially disposed within a portion of ported plug 5.

Valve sleeve 12 is biased upwards by spring 15. Housing inlet flow port 7, flow path 8, and housing outlet flow port 10 together compose housing flow path 7, 8, and 10, through which fluid may flow by entering valve housing 2 from upper sub 1, entering inlet flow port 7, flowing through flow path 8, and then flowing through housing outlet flow port 10. In FIG. 1, sleeve flow port 9 of valve sleeve 12 is not aligned with housing outlet flow port 10. Therefore, in the configuration shown here, fluid cannot flow from housing outlet flow port 10 through sleeve flow port 9, because valve sleeve 12 is blocking the fluid flow path (i.e. the closed position of drill string flow control valve 100). As will be explained herein, valve sleeve 12 is capable of sliding downward so that housing outlet flow port 10 may align with sleeve flow port 9 to allow fluid to flow through drill string flow control valve 100 (i.e. the open position).

Upper pressure port 11 allows fluid pressure PI to be communicated from housing flow path 7, 8, and 10 to upper pressure surface 18. In certain embodiments, upper pressure surface 18 may be a protrusion, extension, and/or cross-sectional surface area of valve sleeve 12 upon which a fluid pressure may act so as to provide a downward acting axial force on valve sleeve 12. In another embodiment, upper pressure surface 18 may be defined as the top of valve sleeve 12. In any event, as fluid pressure PI increases on upper pressure surface 18, valve sleeve is motivated downward by fluid pressure PI acting against the upward bias force of spring 15. Thus, a sufficient fluid pressure acting upon upper pressure surface 18 induces valve sleeve 12 to slide downward. Given sufficient downward force on valve sleeve 12, sleeve flow port 9 will be aligned with housing outlet flow port 10 so as to allow fluid flow to pass through drill string flow control valve 100.

Consequently, fluid flow is thus permitted to pass through drill string flow control valve 100. The fluid flow eventually passes through a drill bit (not shown) and out and upward into the annulus of the well bore to return the drilling mud to the surface. During normal or high flow conditions, a typical drilling mud flow rate will result in a marked pressure drop across the drill bit as the fluid passes through the drill jets of the drill bit. Thus, at any given level of the drill string, the fluid pressure P4 measured in the annulus will be lower than the fluid pressure P2 inside drill string flow control valve 100 on account of the pressure drop that results from the fluid flowing from inside the drill string to the outer annulus. This pressure drop characterized by P2-P4 is usually attributable in large part to the pressure drop experienced across the drill jets of the drill bit.

Lower pressure port 14 allows the fluid pressure P4 in the annulus to be communicated to lower pressure surface 19. Lower pressure surface 19 may be a protrusion, extension, and/or cross-sectional surface area of valve sleeve 12 upon which a fluid pressure may act so as to provide an upward acting axial force on valve sleeve 12. Likewise, lower pressure surface 19 may also be defined as the bottom of valve sleeve 12. In the illustrated embodiment, upper pressure surface 18 and lower pressure surface 19 are defined on the same protrusion. In any event, the fluid pressure P4 in the annulus is allowed to provide an upward force on valve sleeve 12 by acting upon lower pressure surface 19. In this way, both the biasing force of spring 15 and the fluid pressure P4 of the annulus counteract the downward force provided by fluid pressure P1 on upper pressure surface 18. During normal flow conditions, drill string flow control valve 100 is designed so that the fluid flow through drill string flow control valve 100 and the drill bit will result in a pressure drop P1-P4 such that the pressure drop P1-P4 will provide a differential pressure acting upon valve sleeve 12 (via upper pressure surface 18 and lower pressure surface 19) sufficient to keep valve sleeve 12 in the open or substantially open position.

Once the fluid pumps delivering drilling mud to the drill string are shut down and fluid flow decreases, the pressure differential P1-P4 will quickly drop significantly. Pressure differential P1-P4 will no longer be a sufficient to overcome the biasing force of spring 15 and accordingly, valve sleeve will be motivated upwards to its closed position thus impeding or substantially impeding fluid flow through drill string flow control valve 100.

Adjustment shims 17 are provided to adjust the compression of spring 15. By altering the compression of spring 15, the biasing force of spring 15 may be adjusted for different operating conditions of drill string flow control valve 100. Operating conditions to which drill string flow control valve 100 is subjected include, but are not limited to, desired flow rates, fluid densities, depth of drill string flow control valve 100, and expected pressure differentials through the drill bit. Design variables of drill string flow control valve 100 that may be adjusted include, but are not limited to, inner and outer diameters of drill string flow control valve 100, the spring constant (e.g. by changing the wire length, wire diameter, wire material, wire angle, wire pitch, etc.), the size of the flow ports, and the pressure drop through drill string flow control valve 100.

Optional seals S1, S2, S3, and S4 are provided at the indicated locations to prevent leakage of fluid and to prevent communication of fluid pressures to undesired sites around valve sleeve 12.

Although upper pressure surface 18 and lower pressure surface 19 are depicted here as one integral piece, it is explicitly recognized that both surfaces may be composed of separate extensions protruding from valve sleeve 12.

Figure 2:
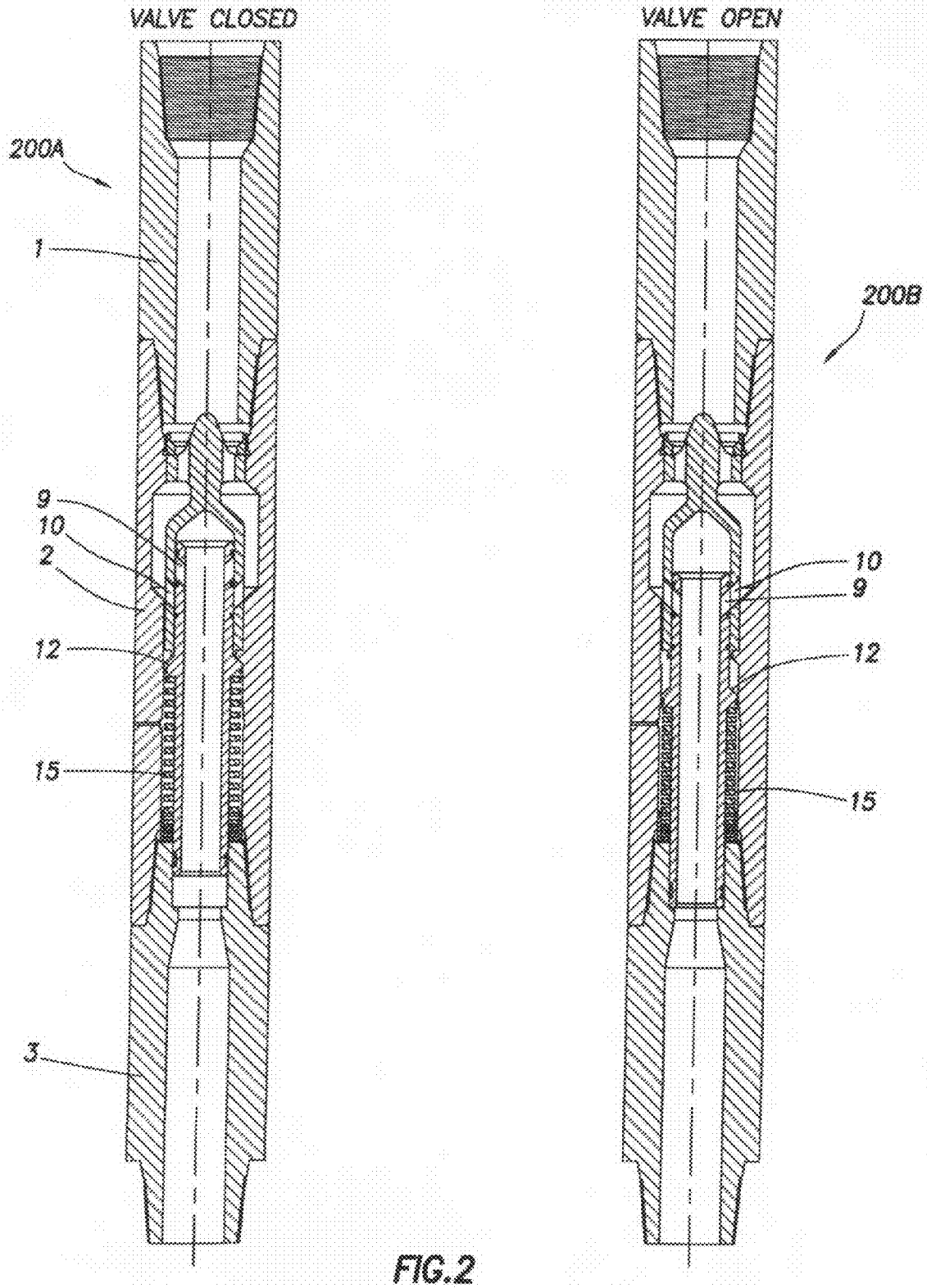
FIG. 2 illustrates a cross-sectional view of a drill string flow control valve shown in a closed position and an open position.

FIG. 2 illustrates a cross-sectional view of a drill string flow control valve shown in both a closed position and an open position. More specifically, drill string flow control valve 200A is shown in the closed position, and drill string flow control valve 200B is shown in the open position.

Drill string flow control valve 200A is shown inline a drill string as attached to upper sub 1 and lower sub 3. Here, valve sleeve 12 is biased in an upward or closed position by spring 15 and consequently, housing outlet flow port 10 and sleeve flow port 9 are out of alignment. Drill string flow control valve 200B, however, is shown in the open position as valve sleeve 12 is biased downward against compressed spring 12 and consequently, housing outlet flow port 10 and sleeve flow port 9 are in substantially alignment.

Figure 3:
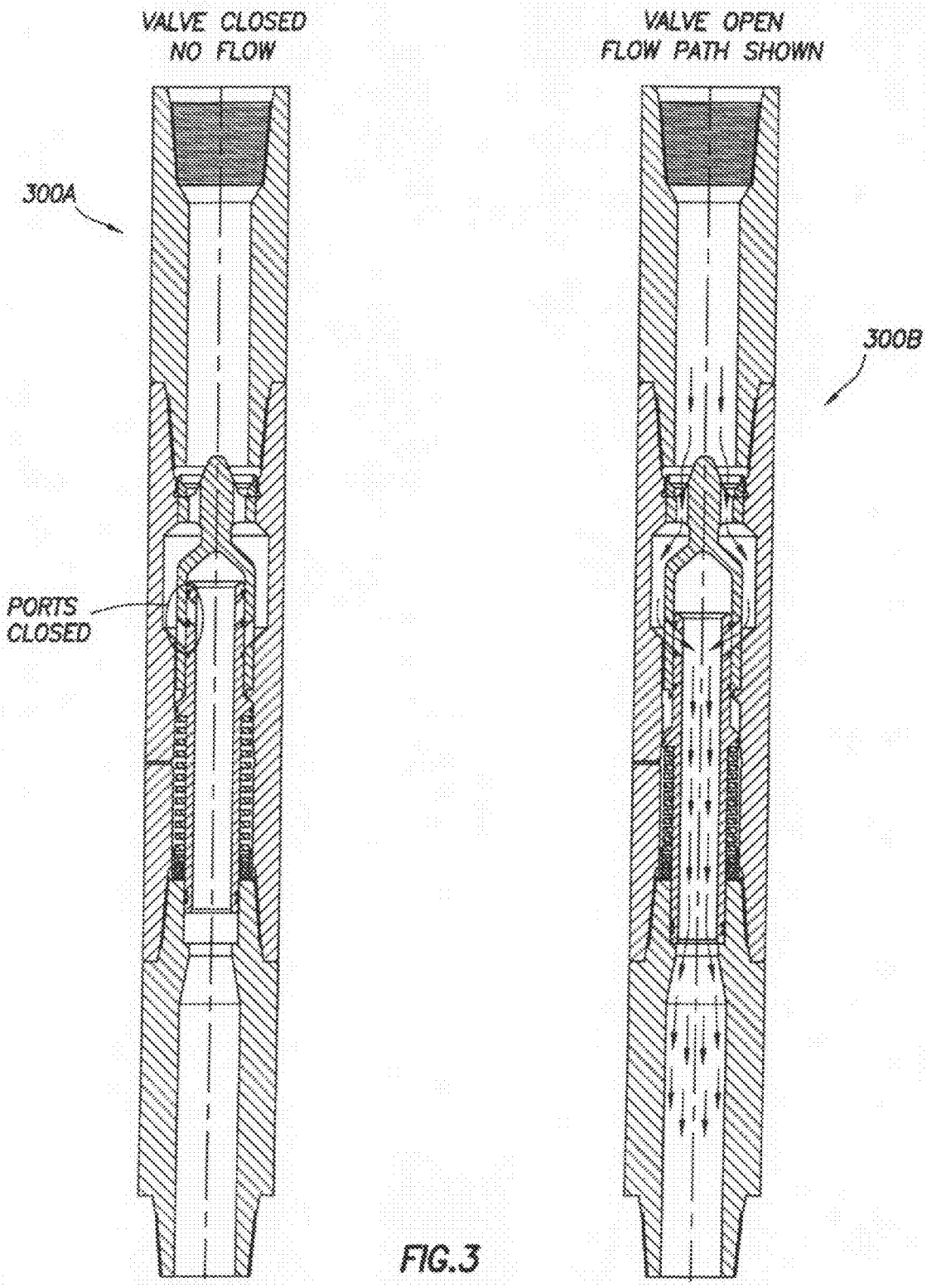
FIG. 3 illustrates a cross-sectional view of a drill string flow control valve shown in a closed position and an open position with flow arrows showing a fluid flow path.

FIG. 3 illustrates a cross-sectional view of a drill string flow control valve shown in a closed position and an open position. The flow arrows indicated in drill string flow control valve 300B indicate the normal fluid flow path when drill string flow control valve 300B is in the open position.

Figure 4:
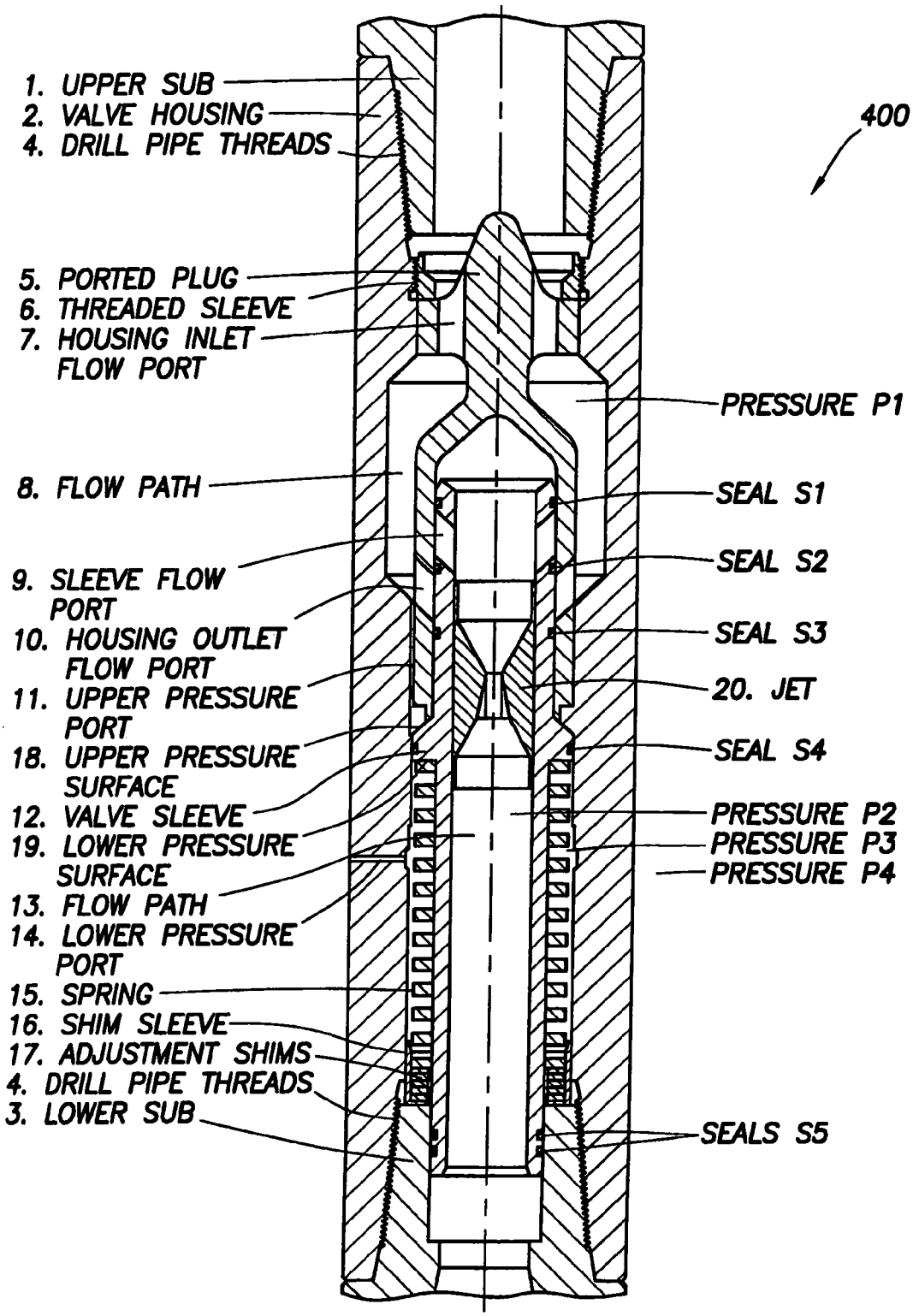
FIG. 4 illustrates a cross-sectional view of a drill string flow control valve having an internal jet.

FIG. 4 illustrates a cross-sectional view of a drill string flow control valve having internal jet 20. The embodiment depicted in FIG. 4 is similar to the embodiment of FIG. 1 with the exception of the addition of jet 20 and a modification of the placement of lower pressure port 14. In this embodiment of FIG. 4, fluid flow through valve sleeve 12 is guided through jet 20. Jet 20 may be any device suitable for producing a measurable pressure drop. Thus, fluid flow passing through jet 20 will experience a pressure drop as the fluid passes through jet 20 such that pressure P2 will be lower than pressure P1. Indeed, under most circumstances, the pressure drop P1-P2 will vary proportional to the fluid flow except under certain choked flow conditions. Lower pressure port 14 allows pressure P2 to be communicated to lower pressure surface 19 to provide an upward force on valve sleeve 12. As before in FIG. 1, upper pressure port 11 allows pressure P1 to be communicated to upper pressure surface 18 to provide a downward force on valve sleeve 12. In this way, pressure differential P1-P2 acts on valve sleeve 12 to provide a net biasing force on valve sleeve 12 to counteract the biasing force of spring 15.

As before in FIG. 1, as fluid flow rate through valve sleeve 12 increases, the net biasing force acting on valve sleeve 12 motivates the sleeve towards the open position. A decrease in fluid flow, on the other hand, motivates valve sleeve 12 towards the closed position. One of the advantages of the embodiment of FIG. 4 is the benefit that only clean fluid enters the region of spring 15 between valve sleeve 12 and outer valve housing 2. In the embodiment of FIG. 1, however, drilling mud from the annulus enters the region of spring 15 between valve sleeve 12 and outer valve housing 2. The drilling mud from the annulus may contain additional drill bit cuttings and debris from the formation, which may cause fouling problems in the region of spring 15.

Here, upper pressure surface 18 and lower pressure surface 19 are depicted as one extension from valve sleeve 12 such that both surfaces or cross-sectional surface areas are formed integrally from one piece or extension of valve sleeve 12. In certain embodiments, however, an upper pressure surface and a lower pressure surface may be formed by separate extensions apart from one another as desired. In such a scenario, it is recognized that an upper pressure surface and lower pressure surface may provide surface areas of different cross-sectional areas. Thus, in this alternative embodiment, pressure PI would act upon a surface area of an upper pressure surface of a first cross-sectional area whereas pressure P3 would act upon a surface area of a lower pressure surface of a second cross-sectional area.

Additionally, although spring 15 is depicted here as acting upon lower pressure surface 19, it is explicitly recognized that spring 15 may act upon any extension of valve sleeve 15 or alternatively, may attach to valve sleeve 15 by any means known in the art, including any known attachment or bonding method known in the art. Thus, in certain embodiments of drill string flow control valve 400, pressure P1 could act upon an upper pressure surface that is distinct and apart from a lower pressure surface upon which pressure P3 acts. Spring 15 may act upon either the upper pressure surface or the lower pressure surface or upon an entirely different pressure surface of valve sleeve 12, or by any attachment of spring 15 to valve sleeve 12 that would allow communication of the potential energy of spring 15 to valve sleeve 12, or any combination thereof. In other embodiments, spring 15 may be disposed to act on another portion of sleeve 12 so long as spring 15 biases valve sleeve 12 into a "closed" position.

The net downward biasing force on valve sleeve 12 may be described by an equation that accounts for the various pressures in the system acting upon the relevant surface areas while taking into account the force exerted by the spring. Additionally, it is clear that the characteristics of the system will also be influenced by the hydrostatic pressure resulting from the depth of the drill string flow control valve and the relevant fluid densities used.

Additionally, in certain embodiments, upper pressure port 11 may communicate any upstream pressure to upper pressure surface 18 while lower pressure port 14 communicates any downstream pressure to lower pressure surface 19. The term "downstream pressure," as used herein, refers to any pressure measured downstream a flow restriction that produces a measurable fluid flow pressure drop after the flow restriction. The term "upstream pressure," as used herein, refers to any pressure measured upstream of the same flow restriction. Examples of suitable flow restrictions include, but are not limited to jets, venturi nozzles, a flow orifices, drill bit jets, any length of piping sufficient to create a measurable pressure drop, or any combination thereof. Further, it is recognized that the communication of pressures from one location to another in the systems described herein may be accomplished with a plurality of ports even though only one port may be described in certain embodiments.

Figure 5:
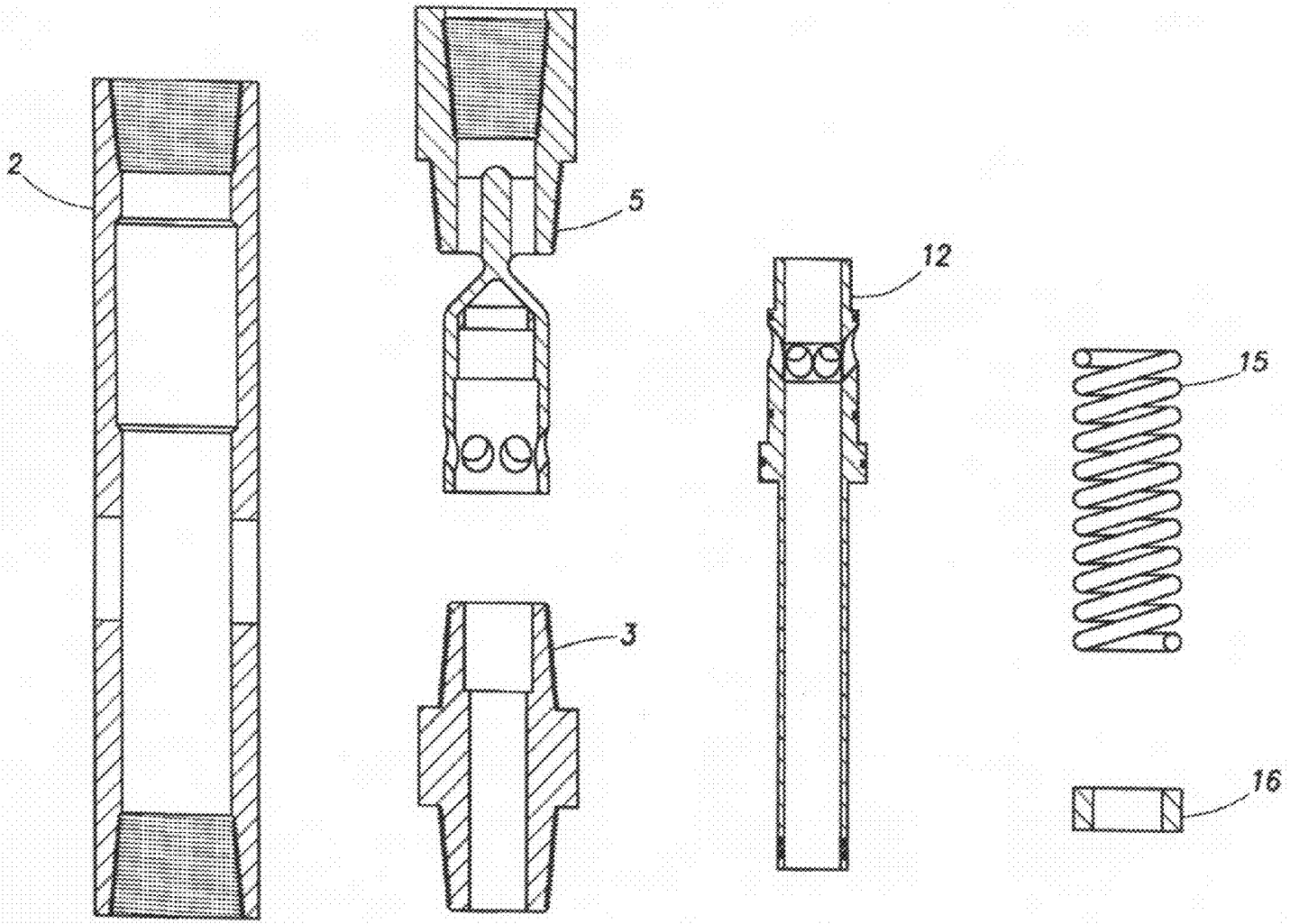
FIG. 5 illustrates several components of one embodiment of a drill string flow control valve shown apart in a disassembled manner.

FIG. 5 illustrates several components of one embodiment of a drill string flow control valve shown apart in a disassembled manner. For clarity, several of the components of one embodiment of a drill string flow control valve are shown apart in a disassembled view in FIG. 5. The components, shown apart here, include valve housing 2, ported plug 5, lower sub 3, valve sleeve 12, spring 15, and shim sleeve 16.

Although drill pipe threads have been depicted herein in several embodiments, it is explicitly recognized that the drill string flow control valves, the joints of drill pipe, and other drill string components herein may be attached to one another by any suitable means known in the art including, but not limited to, drill pipe threads, ACME threads, high-torque shoulder-to-shoulder threads, o-ring seals, welding, or any combination thereof.

While the foregoing has been described in relation to a drill string and is particularly desirable for addressing u-tubing concerns, those skilled in the art with the benefit of this disclosure will appreciate that the drill string flow control valves of the present invention can be used in other fluid flow applications without limiting the foregoing invention.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A drill string flow control valve comprising:

a valve housing characterized by a wall defining a valve interior, wherein the valve housing has an internal housing flow path formed therein with a housing outlet flow port disposed along said internal housing flow path;

a valve sleeve disposed at least partially in the interior of the valve housing, the valve sleeve having a sleeve flow port and a valve sleeve wall, wherein the valve sleeve is axially movable within the valve housing from a closed position to an open position, such that the valve sleeve wall substantially impedes fluid flow from the housing outlet flow port to the sleeve flow port when the valve sleeve is in the closed position and wherein the sleeve flow port and the housing outlet flow port are in substantial alignment when in the open position;

wherein the valve sleeve has an upper pressure surface defined thereon so as to provide a first surface area upon which a first fluid pressure from the internal housing flow path may act to provide a downward force on the valve sleeve and wherein the valve sleeve has a lower pressure surface defined thereon so as to provide a second surface area upon which a second fluid pressure may act to provide an upward force on the valve sleeve;

a spring wherein the spring biases the valve sleeve to the closed position by exertion of a biasing force on the valve sleeve;

an upper pressure port split off from said internal housing flow path, said upper pressure port disposed to allow the first fluid pressure to act upon the upper pressure surface; and a lower pressure port that allows the second fluid pressure to act upon the lower pressure surface from external the valve housing.

2. The drill string flow control valve of claim 1 wherein the valve sleeve is capable of axially shifting from the closed position to the open position by a sufficient differential fluid pressure exerted on the valve sleeve so as to overcome the biasing force of the spring.

3. The drill string flow control valve of claim 1 wherein the drill string flow control valve is axially disposed within a drill string.

4. The drill string flow control valve of claim 1 wherein the drill string flow control valve forms an inline member of a drill string wherein the drill string flow control valve has threaded end connections for attaching to one or more joints of drill pipe.

5. The drill string flow control valve of claim 1 wherein the upper pressure port is axially formed in the housing.

6. The drill string flow control valve of claim 1 further comprising an adjustment shim to allow for adjustment of a tension of the spring.

7. The drill string flow control valve of claim 1 wherein the spring has a spring constant sufficient to prevent u-tubing of fluid flow upon termination of a pumping force.

8. The drill string flow control valve of claim 1 wherein the upper pressure surface and the lower pressure surface comprise an extension protruding from the valve sleeve.

9. The drill string flow control valve of claim 1 wherein the lower pressure surface is an extension protruding from the valve sleeve.

10. The drill string flow control valve of claim 1 wherein the upper pressure surface comprises an extension protruding from the valve sleeve.

11. The drill string flow control valve of claim 1 wherein the spring acts upon the lower pressure surface to produce the biasing force on the valve sleeve.

12. A drill string flow control valve comprising:

a valve housing characterized by a wall defining a valve interior, wherein the valve housing has an internal housing flow path channel formed therein with a housing outlet flow port disposed along said flow path channel;

a valve sleeve disposed at least partially in the valve housing, the valve sleeve having a sleeve flow port and a valve sleeve wall, wherein the valve sleeve is axially movable within the valve housing from a closed position to an open position, such that the valve sleeve wall substantially impedes fluid flow from the housing outlet flow port to the sleeve flow port when the valve sleeve is in the closed position and wherein the sleeve flow port and the housing outlet flow port are substantially aligned when in the open position;

wherein the valve sleeve has a first pressure surface defined thereon so as to provide a first surface area upon which a first fluid pressure from the internal housing flow path channel may act to provide a downward force on the valve sleeve and wherein the valve sleeve has a second pressure surface defined thereon so as to provide a second surface area upon which a second fluid pressure may act to provide an upward force on the valve sleeve;

a biasing mechanism wherein the biasing mechanism biases the valve sleeve to the closed position;

a first pressure channel split off from said internal housing flow path channel, said first pressure channel disposed to allow the first fluid pressure to act upon the first pressure surface; and a second pressure channel that allows the second fluid pressure to act upon the second pressure surface from external the valve housing.

13. The drill string flow control valve of claim 12 wherein the biasing mechanism comprises a spring.

14. The drill string flow control valve of claim 13 wherein the spring comprises a coil spring.

15. A method for preventing u-tubing in a drill string comprising:

providing a valve housing wherein the valve housing has an internal housing flow path defined therein with a housing outlet flow port disposed along said flow path;

providing a valve sleeve disposed at least partially in the valve housing, the valve sleeve having a sleeve flow port and a valve sleeve wall, wherein the valve sleeve is axially movable within the valve housing from a closed position to an open position, such that the valve sleeve wall substantially impedes fluid flow from the housing outlet flow port to the sleeve flow port when the valve sleeve is in the closed position and wherein the sleeve flow port and the housing outlet flow port are substantially aligned when in the open position, wherein the valve sleeve has an upper pressure surface defined thereon so as to provide a first surface area upon which a first fluid pressure from the internal housing flow path may act to provide a downward force on the valve sleeve and wherein the valve sleeve has a lower pressure surface defined thereon so as to provide a second surface area upon which a second fluid pressure may act to provide an upward force on the valve sleeve;

providing a biasing mechanism wherein the biasing mechanism biases the valve sleeve to the closed position by exerting a biasing spring force on the valve sleeve;

providing an upper pressure port split off from said internal housing flow path, said upper pressure port disposed to allow the first fluid pressure to act upon the upper pressure surface with a first force;

providing a lower pressure port that allows the second fluid pressure to act upon the lower pressure surface from external the valve housing with a second force;

introducing drilling fluid into the valve to create a fluid pressure applied to the valve sleeve;

increasing the fluid pressure upon the valve sleeve so as to cause the valve sleeve to shift from the closed position to the open position;

maintaining a drilling fluid flow through the valve sleeve so that the first force is greater than the biasing spring force plus the second force; and decreasing the fluid flow through the valve sleeve so as to allow the biasing mechanism to shift the valve sleeve from the open position to the closed position.

16. The method of claim 15 wherein the biasing mechanism comprises a coiled spring.

17. A drill string flow control valve system comprising:

a valve housing wherein the valve housing has an internal housing flow path formed therein and a housing outlet flow port disposed along said internal housing flow path;

a valve sleeve disposed at least partially in the valve housing, the valve sleeve having a sleeve flow port and a valve sleeve wall wherein the valve sleeve is axially movable within the valve housing from a closed position to an open position, such that the valve sleeve wall substantially impedes fluid flow from the housing outlet flow port to the sleeve flow port when the valve sleeve is in the closed position and wherein the sleeve flow port and the housing outlet flow port are substantially aligned when in the open position;

wherein the valve sleeve has an upper pressure surface defined thereon so as to provide a first surface area upon which a first fluid pressure from the internal housing flow path may act to provide a downward force on the valve sleeve and wherein the valve sleeve has a lower pressure surface defined thereon so as to provide a second surface area upon which a second fluid pressure may act to provide an upward force on the valve sleeve;

a biasing mechanism wherein the spring biases the valve sleeve to the closed position by exertion of a biasing force on the valve sleeve;

a flow restriction in fluid communication with the valve sleeve;

an upper pressure port split off from said internal housing flow path and upstream of the flow restriction, said upper pressure port disposed to allow the first fluid pressure to act upon the upper pressure surface, wherein the first fluid pressure is measured upstream of the flow restriction; and a lower pressure port that allows the second fluid pressure to act upon the lower pressure surface from external the valve housing, wherein the second fluid pressure is measured downstream of the flow restriction.

18. The method of claim 17 wherein the biasing mechanism comprises a spring.

19. The method of claim 17 wherein the flow restriction is disposed inside the valve sleeve.

20. A drill string flow control valve system comprising:

a valve housing having an external surface and a first flow path internally disposed therein;

a valve sleeve slidingly mounted in the valve housing;

a biasing mechanism for biasing the valve sleeve in a closed position;

a first pressure port split off from said internally disposed first flow path, said first pressure port in fluid communication with a first surface of the sleeve to provide a pressure acting on the first surface of the sleeve;

a second pressure port in fluid communication with a second surface of the sleeve to provide a pressure acting on the second surface of the sleeve, said second pressure port in fluid communication with a second flow path; and a drill string having an internal annulus therein, wherein said drill string is disposed in a wellbore, and wherein the first pressure port is in fluid communication with said internal annulus and said second pressure port is in fluid communication with said wellbore.

21. A drill string flow control valve comprising:

a valve housing wherein the valve housing has an internal housing flow path with a housing outlet flow port disposed along said flow path;

a valve sleeve disposed at least partially in the valve housing, the valve sleeve having a sleeve flow port and a valve sleeve wall wherein the valve sleeve is axially movable within the valve housing from a closed position to an open position, such that the valve sleeve wall substantially impedes fluid flow from the housing outlet flow port to the sleeve flow port when the valve sleeve is in the closed position and wherein the sleeve flow port and the housing outlet flow port are substantially aligned when in the open position;

wherein the valve sleeve has an upper pressure surface defined thereon so as to provide a first surface area upon which a first fluid pressure from the housing flow path may act to provide a downward force on the valve sleeve and wherein the valve sleeve has a lower pressure surface defined thereon so as to provide a second surface area upon which a second fluid pressure may act to provide an upward force on the valve sleeve;

a spring wherein the spring biases the valve sleeve to the closed position by exertion of a biasing force on the valve sleeve;

an upper pressure port that allows the first fluid pressure to act upon the upper pressure surface;

a lower pressure port that allows the second fluid pressure to act upon the lower pressure surface from within the valve sleeve; and a restriction in the valve sleeve between upper pressure port and the lower pressure port, said valve sleeve having a first inner diameter substantially along its length and said restriction characterized by a second inner diameter smaller than the first inner diameter.

* * * * *